US011352867B2

(12) United States Patent
Al-Qasim et al.

(10) Patent No.: US 11,352,867 B2
(45) Date of Patent: Jun. 7, 2022

(54) ENHANCED HYDROCARBON RECOVERY WITH ELECTRIC CURRENT

(71) Applicant: Saudi Arabian Oil Company, Dhahran (SA)

(72) Inventors: Abdulaziz S. Al-Qasim, Dammam (SA); Subhash Ayirala, Dhahran (SA); Ali Yousef, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/003,769

(22) Filed: Aug. 26, 2020

(65) Prior Publication Data

US 2022/0065084 A1 Mar. 3, 2022

(51) Int. Cl.
*E21B 43/24* (2006.01)
*E21B 43/20* (2006.01)

(52) U.S. Cl.
CPC ..... *E21B 43/2401* (2013.01); *E21B 43/20* (2013.01)

(58) Field of Classification Search
CPC ..... E21B 43/2401; E21B 43/20
See application file for complete search history.

(56) References Cited

U.S. PATENT DOCUMENTS 1,784,214 A 12/1930 Workman
2,795,279 A * 6/1957 Sarapuu ..... E21B 43/2401 166/248
2,799,641 A * 7/1957 Thomas ..... E21B 43/16 166/248
3,137,347 A * 6/1964 Parker ..... E21B 43/2401 166/248
3,417,823 A * 12/1968 Faris ..... E21B 43/16 166/248
3,428,125 A * 2/1969 Parker ..... E21B 43/2401 166/248
3,469,630 A 9/1969 Hurd et al.
3,507,330 A 4/1970 Gill
3,542,066 A 11/1970 Cordova
(Continued)

FOREIGN PATENT DOCUMENTS

EP 2596208 5/2013
WO WO 2009076006 6/2009
(Continued)

OTHER PUBLICATIONS

Abukhamsin et al., "Inflow profiling and production optimization in smart wells using distributed acoustic and temperature measurements," A dissertation submitted to the Department of Energy Resources Engineering the Committee on Graduate Studies of Stanford University, Jun. 2017, 190 pages.
(Continued)

*Primary Examiner* — Jennifer H Gay
(74) *Attorney, Agent, or Firm* — Fish & Richardson P.C.

(57) ABSTRACT

A method includes alternating between (a) applying an electric current to a subterranean formation and (b) flowing an enhanced oil recovery (EOR) treatment fluid into a wellbore formed in the subterranean formation. The method includes flowing an aqueous salt solution into the wellbore to mobilize hydrocarbons within the subterranean formation after alternating between (a) and (b).

12 Claims, 4 Drawing Sheets

(56) References Cited

U.S. PATENT DOCUMENTS 3,605,888 A * 9/1971 Crowson et al. ... E21B 43/2401 166/248
3,724,543 A 4/1973 Bell et al.
3,782,465 A * 1/1974 Bell ..... E21B 43/2401 166/248
3,848,671 A * 11/1974 Kern ..... E21B 43/2401 166/248
3,946,809 A * 3/1976 Hagedorn ..... E21B 43/18 166/248
3,958,636 A * 5/1976 Perkins ..... E21B 43/2401 166/248
4,010,799 A * 3/1977 Kern ..... E21B 43/2401 166/248
4,206,024 A * 6/1980 Carpenter ..... E21B 43/17 205/766
4,228,853 A * 10/1980 Harvey ..... E21B 17/003 166/245
4,296,812 A 10/1981 Kalfoglou
4,313,500 A 2/1982 Johnson, Jr. et al.
4,382,469 A * 5/1983 Bell ..... E21B 36/00 166/248
4,466,484 A * 8/1984 Kermabon ..... E21B 43/2401 166/60
4,473,114 A * 9/1984 Bell ..... E21B 36/00 166/248
4,495,990 A * 1/1985 Titus ..... E21B 43/2401 166/248
4,499,948 A * 2/1985 Perkins ..... E21B 43/2401 166/248
4,620,592 A 11/1986 Perkins
4,640,353 A * 2/1987 Schuh ..... E21B 7/061 166/117.6
4,643,256 A 2/1987 Dilgren et al.
4,982,789 A 1/1991 Prukop
4,997,044 A 3/1991 Stack
5,042,297 A 8/1991 Lessi
5,109,922 A 5/1992 Joseph
5,517,024 A 5/1996 Mullins et al.
5,868,030 A 2/1999 Burmley et al.
6,814,141 B2 11/2004 Huh et al.
6,877,556 B2 * 4/2005 Wittie ..... E21B 43/16 166/248
6,942,043 B2 9/2005 Kurkoski
7,077,199 B2 7/2006 Vinegar et al.
7,121,342 B2 10/2006 Vinegar et al.
7,325,604 B2 * 2/2008 Wittie ..... E21B 43/16 166/248
7,352,179 B2 4/2008 Chen et al.
7,853,045 B2 12/2010 Touati et al.
7,866,383 B2 1/2011 Dusterhoft et al.
7,980,301 B1 7/2011 Kostrov et al.
8,684,076 B2 4/2014 Kostrov et al.
8,776,880 B2 7/2014 Pich et al.
8,950,495 B2 2/2015 Barbour et al.
8,985,206 B2 3/2015 Morvan et al.
9,133,709 B2 9/2015 Huh et al.
9,212,542 B2 12/2015 Fripp et al.
9,284,480 B2 3/2016 Han et al.
9,328,597 B2 5/2016 Morys
9,394,769 B2 7/2016 Nenniger et al.
9,745,833 B2 8/2017 Carvajal
9,969,928 B2 5/2018 He et al.
10,000,687 B2 6/2018 Al-Yousef et al.
10,041,339 B2 * 8/2018 Jerauld ..... E21B 43/16
10,107,056 B2 10/2018 Zhang et al.
10,184,904 B1 1/2019 Gong et al.
10,196,886 B2 2/2019 Tolman et al.
10,287,486 B2 5/2019 Ayirala et al.
10,563,492 B2 * 2/2020 Stokholm ..... E21B 43/16
2002/0035040 A1 3/2002 Talashek et al.
2003/0102123 A1 * 6/2003 Wittie ..... E21B 43/16 166/248
2005/0199387 A1 * 9/2005 Wittie ..... E21B 43/16 166/248
2009/0110242 A1 4/2009 Touati et al.
2010/0044047 A1 2/2010 Kabishcher et al.
2011/0306525 A1 12/2011 Lightheim
2012/0116443 A1 5/2012 Ferrera et al.
2012/0125604 A1 5/2012 Willingham et al.
2012/0256634 A1 * 10/2012 Morys ..... E21B 43/2401 324/338
2013/0081459 A1 4/2013 Merniche
2013/0274149 A1 10/2013 Lafitte et al.
2013/0277046 A1 10/2013 Haroun et al.
2014/0039793 A1 2/2014 Querales
2014/0338903 A1 11/2014 Mahmoud et al.
2014/0345862 A1 * 11/2014 Jerauld ..... E21B 43/20 166/275
2016/0009981 A1 1/2016 Teklu et al.
2016/0061003 A1 3/2016 Gottumukkala et al.
2017/0241226 A1 * 8/2017 Fathi ..... E21B 33/13
2018/0011211 A1 1/2018 Leonard
2018/0030816 A1 2/2018 Devalve et al.
2018/0230787 A1 * 8/2018 Stokholm ..... E21B 43/16
2018/0253514 A1 9/2018 Bryant et al.
2018/0291717 A1 10/2018 Ayirala et al.
2018/0328152 A1 11/2018 Hart et al.
2018/0347326 A1 12/2018 Shammari et al.
2019/0169969 A1 * 6/2019 Al-Mulhem ..... C25B 1/04
2019/0194524 A1 6/2019 Ayirala et al.

FOREIGN PATENT DOCUMENTS

WO WO 2014160626 10/2014
WO WO-2016048158 A1 * 3/2016 ..... E21B 29/02
WO WO 2016205158 12/2016
WO WO 2017060748 4/2017

OTHER PUBLICATIONS

Al-Anazi et al., "Innovative Production Optimization Technique for Smart Well Completions Using Real-Time Nodal Analysis Applications," SPE-189198-MS, Society of Petroleum Engineers (SPE), presented at the SPE Symposium: Production Enhancement and Cost Optimisation, Nov. 7-8, 2017, 14 pages.

Alghamdi et al., "SmartWater Synergy with Surfactant Chemicals: An Electro-Kinetic Study," SPE-197239-MS, Society of Petroleum Engineers (SPE), presented at the Abu Dhabi International Petroleum Exhibition and Conference, Nov. 11-14, 2019, 12 pages.

Alkandari et al., "Technical Advancement of Carbonate Acid Stimulation Injection," SPE-197982-MS, Society of Petroleum Engineers (SPE), presented at the SPE Kuwait Oil & Gas Conference and Show, Oct. 13-16, 2019, 22 pages.

Alves et al., "Influence of the salinity on the interfacial properties of a Brazilian crude oil-brine systems," Fuel 118: 21-26, Feb. 15, 2014, 6 pages.

Arabzadeh and Amani, "Application of a Novel Ultrasonic Technology to Improve Oil Recovery with an Environmental Viewpoint," Journal of Petroleum and Environmental Biotechnology 08:02, Jan. 2017, 6 pages.

Ayirala et al., "Water ion interactions at crude oil-water interface: A new fundamental understanding of SmartWater flood," SPE 183894-MS, Society of Petroleum Engineers (SPE), presented at the SPE Middle East Oil and Gas Show and Conference, Mar. 6-9, 2017, 17 pages.

Brouwer et al., "Recovery Increase through Water Flooding with Smart Well Technology," SPE 68979, Society of Petroleum Engineers (SPE), presented at the SPE European Formation Damage Conference, May 21-22, 2001, 10 pages.

Bukhamsin et al., "Optimization of multilateral well design and location in a real field using a continuous genetic algorithm," SPE 136944, Society of Petroleum Engineers (SPE), presented at the SPE/DGS Annual Saudi Arabia Section Technical Symposium and Exhibition, Apr. 4-7, 2010, 16 pages.

Cetkovic et al., "A methodology for multilateral wells optimization—field case study," SPE 183004-MS, Society of Petroleum Engineers

(56) References Cited

OTHER PUBLICATIONS (SPE), presented at the Abu Dhabi International Petroleum Exhibition & Conference, Nov. 7-10, 2016, 18 pages.
Edabi and Davies, "Techniques for Optimum Placement of Interval Control Valve(s) in an Intelligent Well," SPE 100191, Society of Petroleum Engineers (SPE), presented at the SPE Europec/EAGE Annual Conference and Exhibition, Austria, Jun. 12-15, 2006, 11 pages.
Elmsallati and Davies, "Automatic Optimization of Infinite Variable Control Valves," IPTC-10319, International Petroleum Technology Conferences (IPTC), presented at the International Petroleum Technology Conference, Qatar, Nov. 21-23, 2005, 7 pages.
Farshi, "Improving Genetic Algorithms for Optimum Well Placement," Master's Report, Department of Energy Resources Engineering, Stanford University, California, Jun. 2008, 94 pages.
flow-industries.com (online), "AirShock Enhanced Oil Recovery," available on or before 2015, retrieved on Nov. 6, 2020, retrieved from URL <https://www.flow-industries.com/oil-and-gas-wells/>, 4 pages.
Ghosh and King, "Optimization of Smart Well Completion Design in the Presence of Uncertainty," SPE 166008, Society of Petroleum Engineers (SPE), presented at the SPE Reservoir Characterization and simulation Conference and Exhibition held in Abu Dhabi, Sep. 16-18, 2013, 17 pages.
Gilev, "Acoustic Well Stimulation of Near-Wellbore Zone for Enhanced Oil Recovery," Center of Ultrasound Technology (CUT Service), 2016, 38 pages.
Glandt, "Reservoir Aspects of Smart Wells," SPE 81107, Society of Petroleum Engineers (SPE), presented at the SPE Latin America and Caribbean Petroleum Engineering Conference, Trinidad, Apr. 27-30, 2003, 11 pages.
Haupt and Haupt, "Practical Genetic Algorithms," 2nd Edition, John Wiley & Sons, New York, 1-253, 2004, 261 pages.
Holland, "Genetic algorithms," Scientific American, 66-79, Jul. 1992, 14 pages.
Jalali et al., "Intelligent Completion System—The Reservoir Rationale," SPE 50587, Society of Petroleum Engineers (SPE), presented at the SPE European Petroleum Conference, Oct. 20-22, 1998, 6 pages.
Lakatos and Lakatos-Szabo, "Effect of IOR/EOR chemicals on interfacial rheological properties of crude oil/water systems," SPE 65391, Society of Petroleum Engineers (SPE), presented at the 2001 SPE International Symposium on Oilfield Chemistry, Feb. 13-16, 2001, 10 pages.
Liu et al., "Favorable Attributes of Alkaline-Surfactant-Polymer Flooding," SPE 99744, Society of Petroleum Engineers (SPE), presented at the 2006 SPE/DOE Symposium on Improved Oil Recoveiy, Apr. 22-26, 2006, SPE Journal, Mar. 2008, 12 pages.
Lorenz et al., "Uniform Inflow Completion System Extended Economic Field Life: A Field Case Study and Technology Overview," SPE 101895, Society of Petroleum Engineers (SPE), presented at the SPE Annual Technical Conference and Exhibition, Texas, Sep. 24-27, 2006, 9 pages.
Ma et al., "Adsorption of Cationic and Anionic Surfactants on natural and Synthetic Carbonate Materials," Journal of Colloid and Interface Science, 408:164-172, 2013, 9 pages.
Malkin et al., "Chapter 2: Viscoelasticity," in Rheology: Concepts, Methods, and Applications, 84 pages.
Mitchell, "An Introduction to Genetic Algorithms," Chapter 1-4, Chapter 6, Appendix A-B, MIT Press, 1996, 162 pages.
Mullakaev et al., "Development of Ultrasonic Equipment and Technology for Well Stimulation and Enhanced Oil Recoveiy," Journal of Petroleum Science and Engineering 125:201-208, 2015, 8 pages.
Naus et al., "Optimization of Commingled Production using Infinitely Variable Inflow Control Valves," SPE 90959, Society of Petroleum Engineers (SPE), presented at the SPE Annual Technical Conference and Exhibition, Texas, Sep. 26-29, 2004, 12 pages.
Pak et al., "Multiscale pore-network representation of heterogeneous carbonate rocks," AGU Publications, Water Resources Research, 52: 5433-5441, 2016, 9 pages.
Qureshi et al., "The Interpretation of Permeability Changes during Acid Injection in Carbonates: A New Integrated Methodology," SPE-177609-MS, Society of Petroleum Engineers (SPE), presented at the Abu Dhabi International Petroleum Exhibition and Conference, Nov. 9-12, 2015, 8 pages.
Radcliff, "Forma Analysis and Random Respectful Recombination," EPCC-TR-91-02, proceedings of 4th International Conference and Genetic Algorithms, San Mateo, CA, 1991, 9 pages.
Rudolph, "Convergence Analysis of Canonic Genetic Algorithms," IEEE Transactions on Neural Networks, Special Issue on Evolutionary Computational 5:1, Jan. 1994, 6 pages.
Sinha et al., "Flow Equilibration Toward Horizontal Well Using Downhole Valves," SPE 68635, Society of Petroleum Engineers (SPE), presented at the SPE Asia Pacific Oil and Gas Conference and Exhibition, Indonesia, Apr. 17-19, 2001, 6 pages.
Tagavifar et al., "Effect of pH on Absorption of Anionic Surfactants on Limestone: Experimental Study and Surface Complexation Modeling," Colloids and Surfaces A: Physiocochemical and Engineering Aspect 538:549-558, Feb. 5, 2018, 10 pages.
Thomas et al., "Alkali and Hybrid-Alkali Flooding as a Tertiary Oil Recovery Mode: Prospects and Challenges," International Journal of Petroleum and Petrochemical Engineering (IJPPE), 2:2 (22-31), 2016, 10 pages.
Wasan et al., "Observations on the coalescence behavior of oil droplets and emulsion stability in enhanced oil recovery," SPE6846, Society of Petroleum Engineers (SPE) of AIME, Dec. 1978, 9 pages.
Westermark et al., "Enhanced Oil Recovery with Downhole Vibration Stimulation," SPE 67303, Society of Petroleum Engineers (SPE), presented at the SPE Production and Operations Symposium, Mar. 24-17, 2001, 13 pages.
Wooden et al., "Seismic Stimulation: An Eco-Friendly, Effective EOR Alternative," Technology Update, JPT, Aug. 2018, 3 pages.
Yeten and Jalali, "Effectiveness of Intelligent Completions in a Multiwell Development," SPE 68077, Society of Petroleum Engineers (SPE), presented at the 2001 SPE Middle East Oil Show, Bahrain, Mar. 17-20, 2017 pages.
Yousef et al., "Laboratory Investigation of the Impact of Injection-Water Salinity and Ionic Content on Oil Recovery for Carbonate Reservoirs," SPE 137634-PA, Society of Petroleum Engineers (SPE), SPE Reservoir Evaluation and Engineering 14:05, Oct. 2011, 5 pages, Abstract only.
Zhang et al., "Favorable Attributes of Alkali-Surfactant-Polymer Flooding," SPE 99744, Society of Petroleum Engineers (SPE), presented at the 2006 SPE/DOE Symposium on Improved Oil Recoveiy, Apr. 22-26, 2006, 13 pages.
PCT International Search Report and Written Opinion in International Appln. No. PCT/US2021/047500, dated Dec. 10, 2021, 15 pages.

* cited by examiner

ENHANCED HYDROCARBON RECOVERY WITH ELECTRIC CURRENT

TECHNICAL FIELD

This disclosure relates to hydrocarbon production from subterranean formations.

BACKGROUND

Primary hydrocarbon recovery involves the extraction of hydrocarbons from a subterranean formation either by the natural pressure within the subterranean formation or facilitation by an artificial lift device, such as an electric submersible pump. Secondary hydrocarbon recovery involves injection of fluid into a subterranean formation to displace hydrocarbons and produce them to the surface. Enhanced oil recovery involves altering a property of the hydrocarbons and/or the subterranean formation to make the hydrocarbons more conducive to extraction.

SUMMARY

Certain aspects of the subject matter described can be implemented as a method. The method includes alternating between (a) applying an electric current to a subterranean formation and (b) flowing an enhanced oil recovery (EOR) treatment fluid into a wellbore formed in the subterranean formation. After alternating between applying the electric current and flowing the EOR treatment fluid, an aqueous salt solution is flowed into the wellbore to mobilize hydrocarbons within the subterranean formation.

This, and other aspects, can include one or more of the following features.

In some implementations, the method includes repeating and alternating between (a) and (b) at least 3 times and up to 12 times for a time duration of up to 3 years.

In some implementations, the electric current is applied to the subterranean formation for a time period of at least 1 week in each iteration.

In some implementations, the EOR treatment fluid is flowed into the wellbore for a time period of at least 3 months in each iteration.

In some implementations, a first iteration of flowing the EOR treatment fluid into the wellbore occurs after a first iteration of applying the electric current to the subterranean formation. In some implementations, a first iteration of applying the electric current to the subterranean formation occurs after a first iteration of flowing the EOR treatment fluid into the wellbore.

In some implementations, the EOR treatment fluid is continuously flowed into the wellbore for each iteration of flowing the EOR treatment fluid into the wellbore.

In some implementations, a voltage of the electric current is the same for each iteration of applying the electric current to the subterranean formation.

In some implementations, a voltage of the electric current decreases for each subsequent iteration of applying the electric current to the subterranean formation.

In some implementations, a voltage of the electric current increases for each subsequent iteration of applying the electric current to the subterranean formation.

In some implementations, the wellbore is a first wellbore. In some implementations, flowing the aqueous salt solution in the first wellbore mobilizes hydrocarbons toward a second wellbore formed in the subterranean formation. In some implementations, the method includes producing the hydrocarbons from the subterranean formation to a surface location from the second wellbore.

Certain aspects of the subject matter described can be implemented as a method. An electric current is applied to a subterranean formation for a time period in a range of from 1 week to 8 weeks. After applying the electric current to the subterranean formation, an enhanced oil recovery (EOR) treatment fluid is flowed into a first wellbore formed in the subterranean formation for a time period in a range of from 2 years to 3 years to improve mobility of hydrocarbons in the subterranean formation. After flowing the EOR treatment fluid into the subterranean formation, an aqueous salt solution is flowed into the first wellbore to mobilize hydrocarbons in the subterranean formation toward a second wellbore formed in the subterranean formation. Hydrocarbons are produced from the subterranean formation to a surface location from the second wellbore.

This, and other aspects, can include one or more of the following features.

In some implementations, the EOR treatment fluid includes magnetic particles.

In some implementations, the method includes applying an electric current to the subterranean formation while flowing the EOR treatment fluid into the first wellbore. In some implementations, the magnetic particles of the EOR treatment fluid propagate the electric current applied to the subterranean formation.

In some implementations, applying the electric current to the subterranean formation includes generating the electric current within the subterranean formation using an anode positioned within the first wellbore and a cathode positioned within the second wellbore.

In some implementations, applying the electric current to the subterranean formation includes generating the electric current using an anode positioned at a surface location and a cathode positioned within the second wellbore.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A well is treated to improve hydrocarbon production from a subterranean formation. The treatment includes repeating and alternating between applying an electric current to the subterranean formation and injecting a treatment fluid into the subterranean formation. This portion of the treatment can improve the mobility of the hydrocarbons within the subterranean formation. After alternating between these steps, the treatment includes a waterflooding step to mobilize the hydrocarbons in the subterranean formation and subsequently produce them to the surface.

The subject matter described in this disclosure can be implemented in particular implementations, so as to realize one or more of the following advantages. The alternation between the application of electric current and injection of treatment fluid improves hydrocarbon mobility within subterranean formations, which allows for increased hydrocarbon production. The repeating and alternation of the application of electric current and injection of treatment fluid exhibit synergistic effects that improve hydrocarbon production from a subterranean formation in comparison to the sum of implementing the steps individually.

Figure 1A:
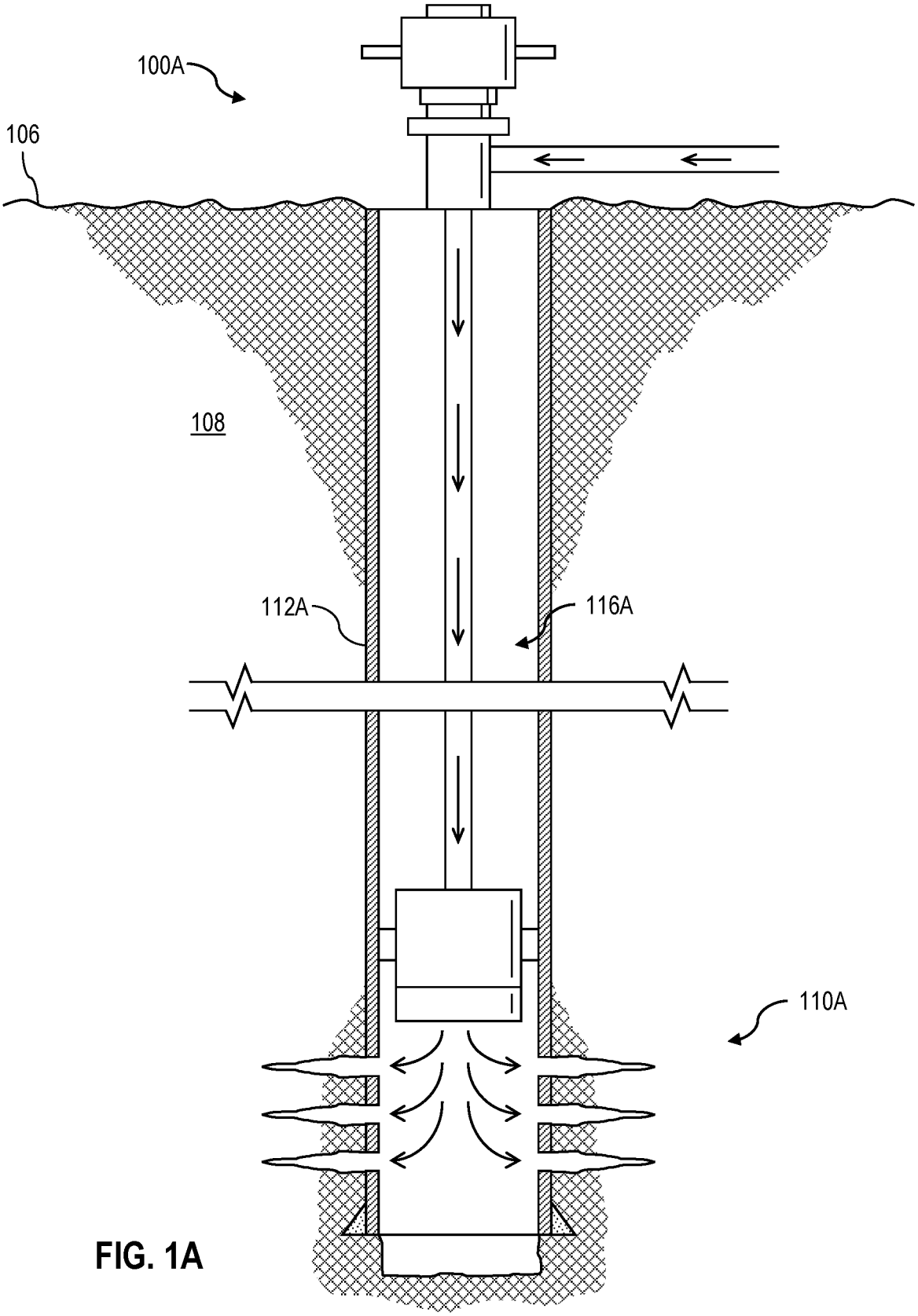
FIG. 1A is a schematic diagram of an example well.
Figure 1B:
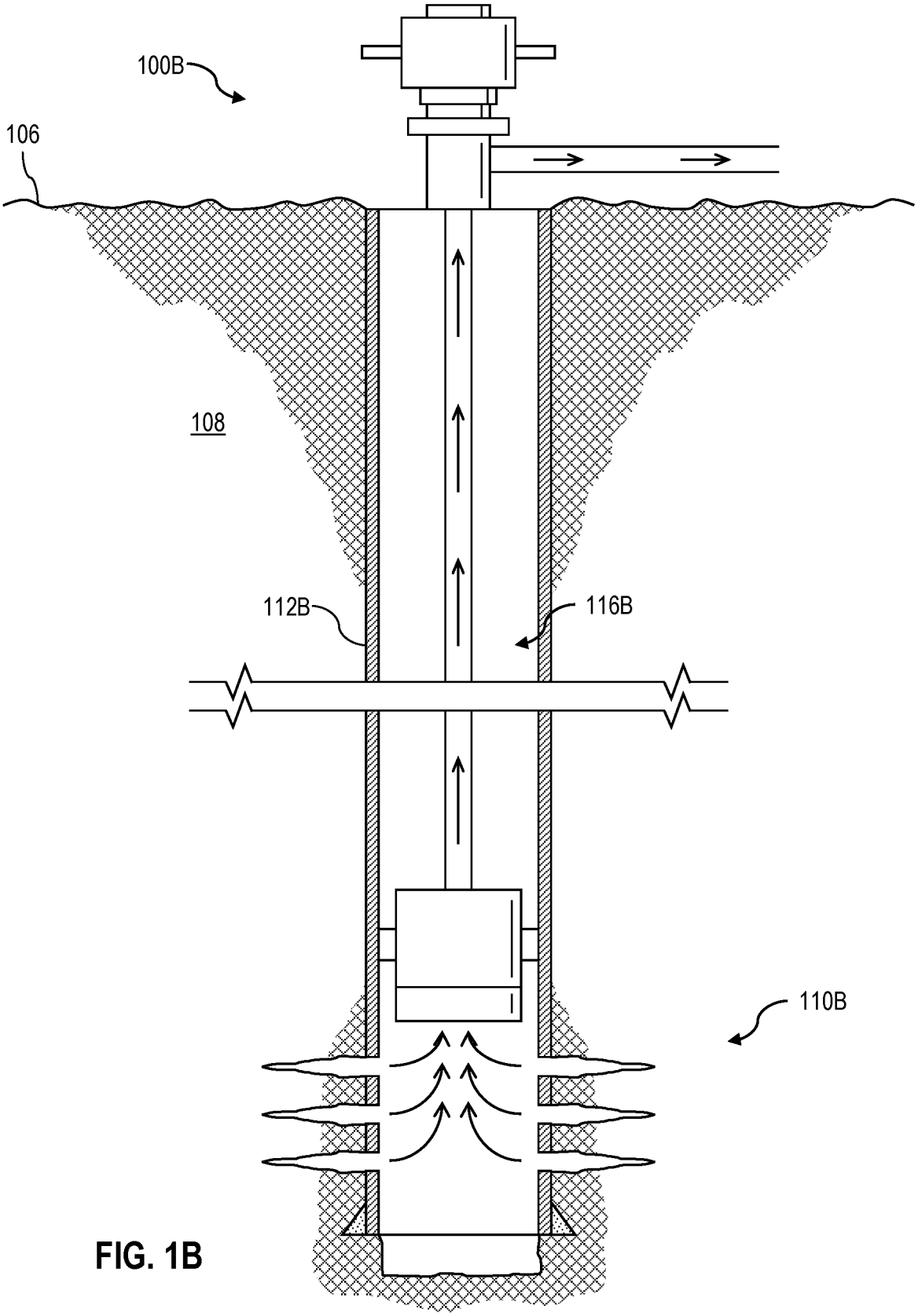
FIG. 1B is a schematic diagram of an example well.

FIGS. 1A and 1B depict an example wells 100A and 100B, respectively, constructed in accordance with the concepts herein. The wells 100A and 100B extend from the surface 106 through the Earth 108 to subterranean zones of interest 110A and 110B, respectively. The wells 100A and 100B enable access to the subterranean zones of interest 110A and 110B, respectively, to allow recovery (that is, production) of fluids to the surface 106 shown in FIG. 1B) and, in some implementations, additionally or alternatively allows fluids to be placed in the Earth 108 (shown in FIG. 1A). In some implementations, the subterranean zones 110A and 110B are formations within the Earth 108 defining a reservoir, but in other instances, the zones 110A and 100B can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the wells 100A and 100B are shown as vertical wells, but in other instances, the wells 100A and 100B can be deviated wells with wellbores deviated from vertical (for example, horizontal or slanted), the wells 100A and 100B can include multiple bores forming a multilateral well (that is, a well having multiple lateral wells branching off another well or wells), or both.

In some implementations, as shown in FIG. 1A, the well 100A is an injection well that is used to inject fluid from the surface 106 and into the subterranean zones of interest 110A. The concepts herein, though, are not limited in applicability to injection wells, and could be used in production wells (such as gas wells or oil wells) as shown in FIG. 1B, wells for producing other gas or liquid resources or could be used in injection wells, disposal wells, or other types of wells similarly used in placing fluids into the Earth. The term "gas well" refers to a well that is used in producing hydrocarbon gas (such as natural gas) from the subterranean zones of interest 110B to the surface 106. While termed "gas well," the well need not produce only dry gas, and may incidentally or in much smaller quantities, produce liquid including oil, water, or both. The term "oil well" refers to a well that is used in producing hydrocarbon liquid (such as crude oil) from the subterranean zones of interest 110B to the surface 106. While termed an "oil well," the well not need produce only hydrocarbon liquid, and may incidentally or in much smaller quantities, produce gas, water, or both. In some implementations, the production from a gas well or an oil well can be multiphase in any ratio. In some implementations, the production from a gas well or an oil well can produce mostly or entirely liquid at certain times and mostly or entirely gas at other times. For example, in certain types of wells, it is common to produce water for a period of time to gain access to the gas in the subterranean zone.

The wellhead defines an attachment point for other equipment to be attached to the wells 100A and 100B. For example, FIG. 1B shows well 100B being produced with a Christmas tree attached to the wellhead. The Christmas tree includes valves used to regulate flow into or out of the wells 100A and 100B. The wellbores of the wells 100A and 100B are typically, although not necessarily, cylindrical. All or a portion of the wellbores are lined with tubings, such as casings 112A and 112B. The casings 112A and 112B connect with wellheads at the surface 106 and extend downhole into the wellbore. The casings 112A and 112B operate to isolate the bores of the wells 100A and 100B, respectively, defined in the cased portions of the wells 100A and 100B by the inner bores 116A and 116B of the casings 112A and 112B, respectively, from the surrounding Earth 108. The casings 112A and 112B can be formed of a single continuous tubing or multiple lengths of tubing joined (for example, threadedly) end-to-end. In FIGS. 1A and 1B, the casings 112A and 112B are perforated in the subterranean zones of interest 110A and 110B to allow fluid communication between the subterranean zones of interest 110A and 110B and the bores 116A and 116B of the casings 112A and 112B, respectively. In some implementations, the casings 112A and 112B are omitted or ceases in the region of the subterranean zones of interest 110A and 110B, respectively. These portions of the wells 100A and 100B without casing are often referred to as "open hole."

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size.

Figure 2A:
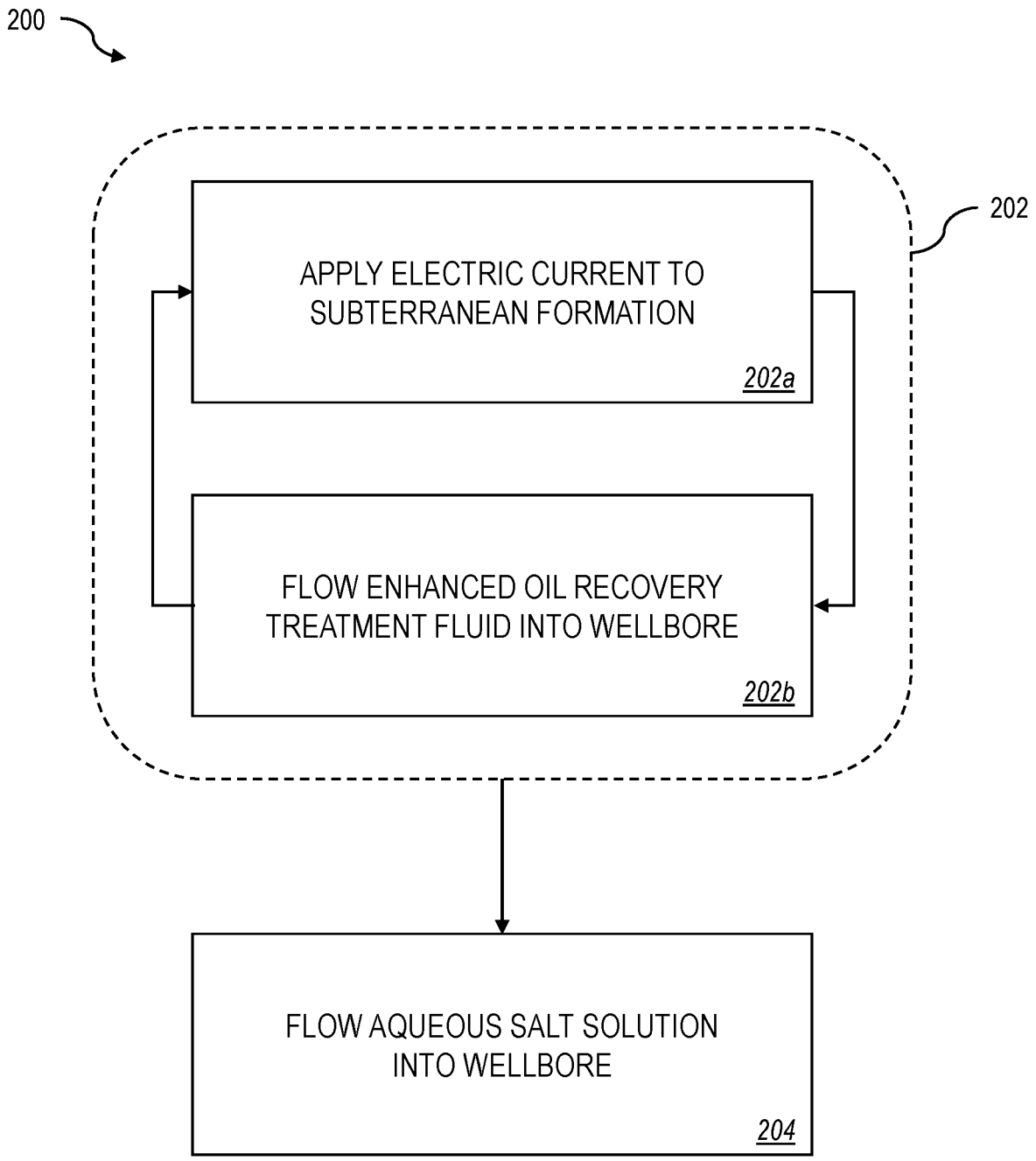
FIG. 2A is a flow chart of an example method that can be implemented in the well of FIG. 1A.

FIG. 2A is a flow chart of a method 200 that can be implemented on a subterranean formation including hydrocarbons. A wellbore (for example, an implementation of the well 100A of FIG. 1A) is formed in the subterranean formation as part of an injection well. Step 202 includes two sub-steps 202*a* and 202*b*. Step 202 involves alternating between sub-steps 202*a* and 202*b*. At sub-step 202*a*, an electric current is applied to the subterranean formation.

The electric current can be applied to the subterranean formation at sub-step 202*a*, for example, by using a pair of electrodes. For example, a pair of electrodes generates the electric current that is applied to the subterranean formation at sub-step 202*a*. In some implementations, a cathode is positioned at the surface 106, and an anode is positioned within the wellbore. In some implementations, an anode is positioned at the surface 106, and a cathode is positioned within the wellbore. In some implementations, a cathode and an anode are positioned within the wellbore. In some implementations, an anode is positioned within the wellbore that is part of the injection well, and a cathode is positioned in a different wellbore that is part of a production well. In some implementations, an anode is positioned at the surface 106, and a cathode is positioned in a wellbore that is part of a production well.

In some implementations, at each iteration of sub-step 202*a*, the electric current is applied to the subterranean formation for a time period of at least 1 week. Applying the electric current to the subterranean formation can result in increasing a temperature of fluid within the subterranean formation. Applying the electric current to the subterranean formation can result in decreasing a viscosity of fluid within the subterranean formation. Each of these effects can improve hydrocarbon mobility within the subterranean formation. In some implementations, at each iteration of sub-step 202*a*, the electric current is applied to the subterranean formation for a time period of up to 8 weeks. In some implementations, at each iteration of sub-step 202*a*, the electric current is applied to the subterranean formation for a time period of up to 4 weeks. In some implementations, at each iteration of sub-step 202*a*, the electric current is applied to the subterranean formation for a time period of at least 1 week and up to 8 weeks. In some implementations, at each iteration of sub-step 202*a*, the electric current is applied to the subterranean formation for a time period of at least 1 week and up to 4 weeks. In some implementations, the time period for each iteration of sub-step 202*a* is the same. For example, the time period for each iteration of sub-step 202*a* is 1 week, 2 weeks, 3 weeks, 4 weeks, 5 weeks, 6 weeks, 7 weeks, or 8 weeks. In some implementations, the time period of some iterations of sub-step 202*a* is the same but different from those of the remaining iterations of sub-step 202*a*. In some implementations, the time period for each iteration of sub-step 202*a* is different. In some implementations, each subsequent iteration of sub-step 202*a* is performed for a time period that is shorter in comparison to the iteration of sub-step 202*a* that preceded it. For example, the time period of each iteration of sub-step 202*a* gradually decreases starting from a time period of 8 weeks to a time period of 1 week. In some implementations, each subsequent iteration of sub-step 202*a* is performed for a time period that is longer in comparison to the iteration of sub-step 202*a* that preceded it. For example, the time period of each iteration of sub-step 202*a* gradually increases starting from a time period of 1 week to a time period of 8 weeks. In some implementations, each iteration of sub-step 202*a* alternates between two different time periods. For example, each iteration of sub-step 202*a* alternates between being performed for 1 week and being performed for 8 weeks.

In some cases, applying the electric current to the subterranean formation for less than 1 week for a single iteration of sub-step 202*a* may not sufficiently improve mobility of hydrocarbons within the subterranean formation. In some cases, applying the electric current to the subterranean formation for longer than 8 weeks may consume excess energy without yielding an appreciable increase in hydrocarbon mobility within the subterranean formation. The length of the time period for each iteration of sub-step 202*a* can depend on various factors, such as viscosity of hydrocarbon fluid within the subterranean formation and distance between the electrodes. For example, the time period of each iteration of sub-step 202*a* may be longer for hydrocarbons with increased viscosity. For example, the time period of each iteration of sub-step 202*a* may be longer for electrodes that are positioned farther apart from each other.

In some implementations, the voltage of the electric current that is applied to the subterranean formation is the same for each iteration of sub-step 202*a*. In some implementations, the voltage of the electric current that is applied to the subterranean formation is the same for some iterations of sub-step 202*a* but different for other iterations of sub-step 202*a*. In some implementations, the voltage of the electric current that is applied to the subterranean formation is different for each iteration of sub-step 202*a*. In some implementations, for each subsequent iteration of sub-step 202*a*, the voltage of the electric current that is applied to the subterranean formation decreases. For example, for subterranean formations that have high viscosity hydrocarbons, starting with a high voltage (such as 100 V to 400 V with a current of up to 2,000 amperes) can initiate hydrocarbon mobilization and then a gradual decrease in voltage may be sufficient in maintaining hydrocarbon mobilization. In some implementations, for each subsequent iteration of sub-step 202*a*, the voltage of the electric current that is applied to the subterranean formation increases. For example, for subterranean formations that have low or medium viscosity hydrocarbons, starting with a low voltage (such as 50 V to 150 V with a current of up to 500 amperes) may be sufficient to initiate hydrocarbon mobilization and then a gradual increase in voltage can improve connectivity of hydrocarbon deposits, for example, to form an oil bank. For example, high viscosity hydrocarbons can be considered to be hydrocarbons with an American Petroleum Institute (API) gravity of less than 30 and viscosities in a range of from about 10 centipoise (cP) to about 100 cP. For example, low viscosity hydrocarbons can be considered to be hydrocarbons with an API gravity of at least 30 and viscosities in a range of from about 2 cP to about 10 cP.

At sub-step 202*b*, an enhanced oil recovery (EOR) treatment fluid is flowed into the wellbore. The EOR treatment fluid is a fluid that alters the original properties of the hydrocarbons trapped in the subterranean formation or the subterranean formation itself, such that additional extraction of the hydrocarbons from the subterranean formation is possible. The EOR treatment fluid is a fluid that improves mobility of hydrocarbons within the subterranean formation. For example, the EOR treatment fluid can alter the subterranean formation, such that the subterranean formation becomes more water-wetting, so that oil can be displaced more easily. The EOR treatment fluid not only restores pressure within the subterranean formation, but also improves oil displacement and/or fluid flow in the subterranean formation. For example, the EOR treatment fluid can reduce oil/water interfacial tension and alter the wettability of a rock surface toward water-wetting (away from oil-wetting). For example, the EOR treatment fluid can cause oil swelling, thereby reducing viscosity (and in turn, increasing mobility) of hydrocarbons in the subterranean formation. Applying the electric current to the subterranean formation at sub-step 202*a* can improve the rheology of hydrocarbons within the subterranean formation (for example, reduce viscosity), thereby reducing the requirements of the EOR treatment fluid. For example, the EOR treatment fluid can include a decreased concentration of polymer due to implementation of sub-step 202*a*. The EOR treatment fluid can be flowed into the wellbore at sub-step 202*b*, for example, using a pump. The pump can be located at the surface 106 or positioned within the wellbore.

In some implementations, the EOR treatment fluid is an aqueous fluid that includes an additive. Some examples of suitable additives include salt, friction reducer, polymer, non-magnetic particulate, magnetic particulate, surfactant, dissolved carbon dioxide, nanoparticles, and biocide. In some implementations, the EOR treatment fluid includes a smart water with a tailored salt water chemistry composition. For example, the EOR treatment fluid can be an aqueous fluid with a total dissolved solids (TDS) level in a range of from about 5,000 parts per million (ppm) to about 7,000 ppm, comprising about 400 ppm to about 1,000 ppm sulfate ions and about 300 ppm to about 600 ppm calcium and/or magnesium ions. In some implementations, the EOR treatment fluid includes an additive that is affected by the electric current applied at sub-step 202*a*. For example, the EOR treatment fluid can include magnetic particles that extend the reach of the electric current applied at sub-step 202*a*.

In some implementations, at each iteration of sub-step 202*b*, the EOR treatment fluid is flowed into the wellbore for a time period of at least 3 months. In some implementations, at each iteration of sub-step 202*b*, the EOR treatment fluid is flowed into the wellbore for a time period of up to 6 months. In some implementations, at each iteration of sub-step 202*b*, the EOR treatment fluid is flowed into the wellbore for a time period of at least 3 months and up to 6 months. In some implementations, the time period for each iteration of sub-step 202*b* is the same. For example, the time period for each iteration of sub-step 202*b* is 3 months, 3.5 months, 4 months, 4.5 months, 5 months, 5.5 months, or 6 months. In some implementations, the time period of some iterations of sub-step 202*b* is the same but different from those of the remaining iterations of sub-step 202*b*. In some implementations, the time period for each iteration of sub-step 202*b* is different. In some implementations, each subsequent iteration of sub-step 202*b* is performed for a time period that is shorter in comparison to the iteration of sub-step 202*b* that preceded it. For example, the time period of each iteration of sub-step 202*b* gradually decreases starting from a time period of 6 months to a time period of 3 months. In some implementations, each subsequent iteration of sub-step 202*b* is performed for a time period that is longer in comparison to the iteration of sub-step 202*b* that preceded it. For example, the time period of each iteration of sub-step 202*b* gradually increases starting from a time period of 3 months to a time period of 6 months. In some implementations, each iteration of sub-step 202*b* alternates between two different time periods. For example, each iteration of sub-step 202*b* alternates between being performed for 3 months and being performed for 6 months.

In some cases, flowing the EOR treatment fluid into the wellbore for less than 3 months for a single iteration of sub-step 202*b* may not provide sufficient volume of EOR treatment fluid to adequately react with the subterranean formation and downhole fluids, such that a favorable interaction occurs both at the oil/brine interface and the rock/brine interfaces to cause interfacial tension reduction, wettability alteration toward water-wetting, and initiate beneficial effects for mobilizing hydrocarbons within the subterranean formation. In some cases, flowing the EOR treatment fluid into the wellbore for longer than 6 months for a single iteration of sub-step 202*b* may provide unnecessarily excess volume of EOR treatment fluid which can potentially adversely impact economics of hydrocarbon production.

In some implementations, at each iteration of sub-step 202*b*, the EOR treatment fluid is continuously flowed into the wellbore. In some implementations, at each iteration of sub-step 202*b*, the EOR treatment fluid is flowed into the wellbore in pulses. In some implementations, the EOR treatment fluid is continuously flowed into the wellbore for some iterations of sub-step 202*b*, while the EOR treatment fluid is flowed into the wellbore in pulses for other iterations of sub-step 202*b*. The manner in which the EOR treatment fluid is flowed into the wellbore at any of the iterations of sub-step 202*b* can be determined based on various factors, such as wellbore condition, composition of downhole fluid, composition of the EOR treatment fluid, and type of source rock present in the subterranean formation. In some cases, continuously flowing the EOR treatment fluid into the wellbore at sub-step 202*b* can maintain pressure in the subterranean formation more effectively in comparison to flowing the EOR treatment fluid into the wellbore in pulses. In some cases, flowing the EOR treatment fluid into the wellbore in pulses can remove accumulated particulates near the wellbore or mitigate wellbore blockages more effectively in comparison to continuously flowing the EOR treatment fluid into the wellbore.

In some implementations, step 202 includes repeating and alternating between sub-steps 202*a* and 202*b* at least 3 times (that is, 3 iterations of sub-step 202*a* and 3 iterations of sub-step 202*b*, alternating). In some implementations, step 202 includes repeating and alternating between sub-steps 202*a* and 202*b* up to 12 times (that is, 12 iterations of sub-step 202*a* and 12 iterations of sub-step 202*b*, alternating). In some implementations, step 202 includes repeating one more iteration of either sub-step 202*a* or sub-step 202*b*, depending on whichever sub-step was performed last, before moving onto step 204. In some implementations, step 202 includes repeating and alternating between sub-steps 202*a* and 202*b* for a time duration of at least 2 years. In some implementations, step 202 includes repeating and alternating between sub-steps 202*a* and 202*b* for a time duration of up to 3 years. In some implementations, step 202 includes repeating and alternating between sub-steps 202*a* and 202*b* for a time duration in a range of from 2 years to 3 years. The total time duration of 2 years to 3 years for step 202 can be considered sufficient for injecting 0.3 to 0.5 pore volumes of EOR treatment fluid into the subterranean formation. In some implementations, step 202 includes repeating and alternating between sub-steps 202*a* and 202*b* until 0.3 to 0.5 pore volumes of EOR treatment fluid are injected into the subterranean formation.

Although written as sub-steps 202*a* and 202*b*, sub-step 202*a* need not occur before sub-step 202*b*. In some implementations, the first iteration of sub-step 202*a* (electric current application) occurs after the first iteration of sub-step 202*b* (EOR treatment fluid injection). In some implementations, the first iteration of sub-step 202*b* occurs after the first iteration of sub-step 202*a*.

At step 204, an aqueous salt solution is flowed into the wellbore to mobilize hydrocarbons within the subterranean formation. The aqueous salt solution at step 204 serves as a flooding medium. A second wellbore (for example, another implementation of the well 100B of FIG. 1B) is formed in the subterranean formation as part of a production well. Flowing the aqueous salt solution into the first wellbore at step 204 causes hydrocarbons within the subterranean formation to mobilize toward the second wellbore. The hydrocarbons are produced from the subterranean formation to a surface location (for example, the surface 106) from the second wellbore.

The salt content of the aqueous salt solution flowed into the wellbore at step 204 can depend on various factors, such as salinity of formation water of the subterranean formation, wettability of a target zone of the subterranean formation, and type of source rock present in the subterranean formation. In some implementations, the aqueous salt solution has a total dissolved solids (TDS) level of at least 20,000 parts per million (ppm). In some implementations, the aqueous salt solution has a TDS level of at least 30,000 ppm. In some implementations, the aqueous salt solution has a TDS level of up to 60,000 ppm. In some implementations, the aqueous salt solution has a TDS level in a range of from 30,000 ppm to 60,000 ppm. In some implementations, the aqueous salt solution includes seawater.

Figure 2B:
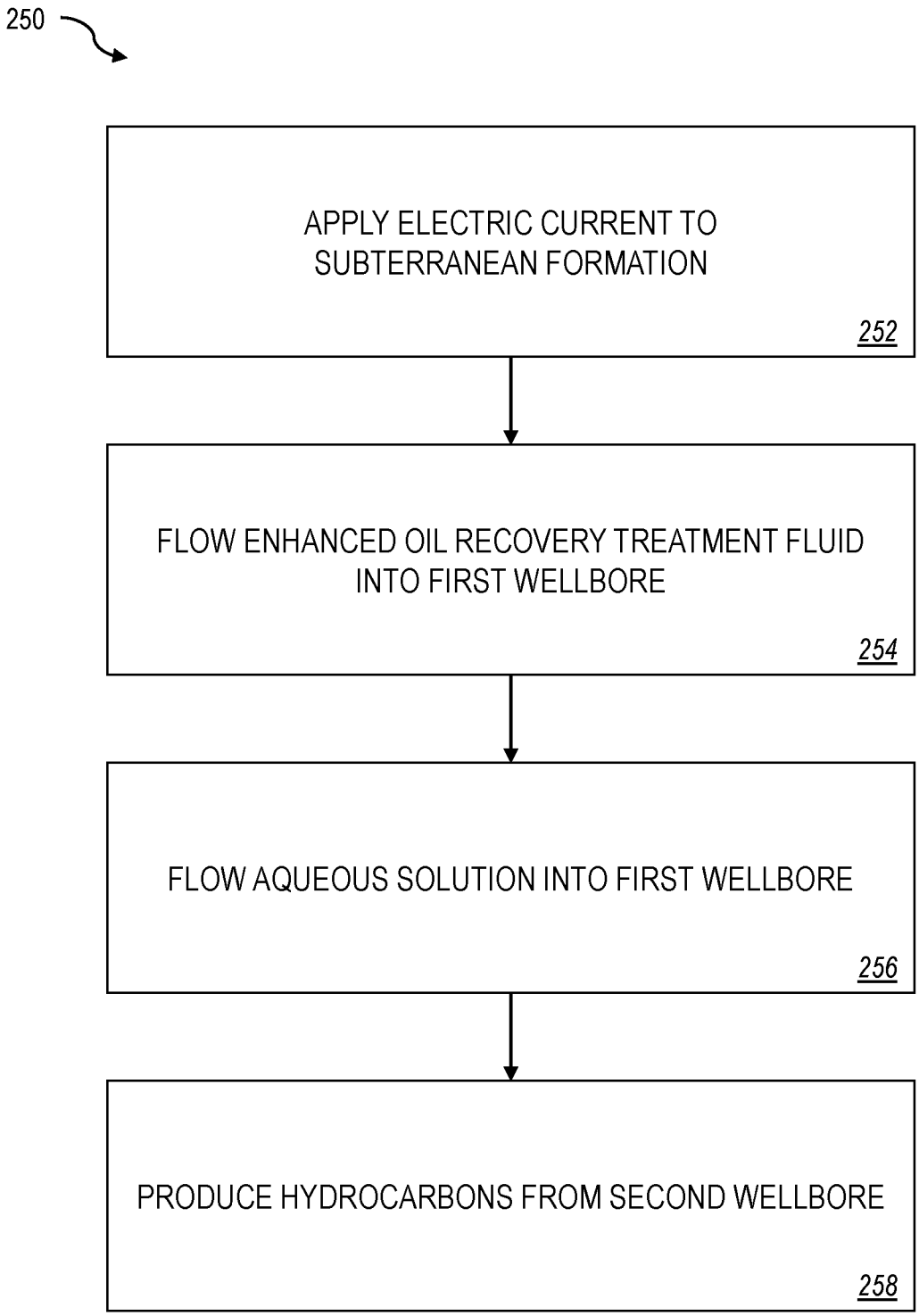
FIG. 2B is a flow chart of an example method that can be implemented in the wells of FIGS. 1A and 1B.

FIG. 2B is a flow chart of a method 250 that can be implemented on a subterranean formation including hydrocarbons. At step 252, an electric current is applied to the subterranean formation for a time period in a range of from 1 week to 8 weeks. In some implementations, applying the electric current to the subterranean formation at step 252 includes generating the electric current within the subterranean formation by using an anode positioned within a first wellbore formed in the subterranean formation and a cathode positioned within a second wellbore formed in the subterranean formation. The first wellbore (for example, an implementation of the well 100A of FIG. 1A) is formed in the subterranean formation as part of an injection well. The second wellbore (for example, another implementation of the well 100B of FIG. 1B) is formed in the subterranean formation as part of a production well. In some implementations, applying the electric current to the subterranean formation at step 252 includes generating the electric current by using an anode positioned at a surface location (for example, the surface 106) and a cathode positioned within the second wellbore.

After applying the electric current to the subterranean formation at step 252, an EOR treatment fluid is flowed into the first wellbore formed in the subterranean formation for a time period in a range of from 2 years to 3 years at step 254. Flowing the EOR treatment into the first wellbore at step 254 improves mobility of hydrocarbons in the subterranean formation. As described previously, in some implementations, the EOR treatment fluid includes magnetic particles. In some implementations, the method 250 includes applying an electric current (either the same as or different from the electric current applied at step 252) to the subterranean formation while flowing the EOR treatment fluid into the first wellbore at step 254. In such implementations, the magnetic particles of the EOR treatment can propagate the electric current applied to the subterranean formation.

After flowing the EOR treatment fluid into the first wellbore at step 254, an aqueous salt solution is flowed into the first wellbore at step 256. Flowing the aqueous salt solution into the first wellbore at step 256 mobilizes the hydrocarbons in the subterranean formation toward the second wellbore formed in the subterranean formation.

At step 258, the hydrocarbons are produced from the subterranean formation to a surface location (for example, the surface 106) from the second wellbore.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

alternating between:

(a) applying an electric current to a subterranean formation; and (b) flowing an enhanced oil recovery (EOR) treatment fluid into a wellbore formed in the subterranean formation, wherein a first iteration of flowing the EOR treatment into the wellbore occurs after a first iteration of applying the electric current to the subterranean formation, and the method comprises alternatingly repeating (a) and (b) a plurality of times; and after alternatingly repeating between applying the electric current and flowing the EOR treatment fluid, flowing an aqueous salt solution into the wellbore to mobilize hydrocarbons within the subterranean formation.

2. The method of claim 1, wherein the EOR treatment fluid is continuously flowed into the wellbore for each iteration of flowing the EOR treatment fluid into the wellbore.

3. The method of claim 2, wherein the wellbore is a first wellbore, flowing the aqueous salt solution into the first wellbore mobilizes hydrocarbons toward a second wellbore formed in the subterranean formation, and the method comprises producing the hydrocarbons from the subterranean formation to a surface location from the second wellbore.

4. The method of claim 1 wherein a voltage of the electric current is the same for each iteration of applying the electric current to the subterranean formation.

5. The method of claim 1, wherein a voltage of the electric current decreases for each subsequent iteration of applying the electric current to the subterranean formation.

6. The method of claim 1, wherein a voltage of the electric current increases for each subsequent iteration of applying the electric current to the subterranean formation.

7. A method comprising:

applying an electric current to a subterranean formation for a time period in a range of from 1 week to 8 weeks;

after applying the electric current to the subterranean formation, flowing an enhanced oil recovery (EOR) treatment fluid into a first wellbore formed in the subterranean formation for a time period in a range of from 2 years to 3 years;

after flowing the EOR treatment fluid into the subterranean formation, flowing an aqueous salt solution into the first wellbore to mobilize hydrocarbons in the subterranean formation toward a second wellbore formed in the subterranean formation; and producing hydrocarbons from the subterranean formation to a surface location from the second wellbore.

8. The method of claim 7, wherein the EOR treatment fluid comprises magnetic particles.

9. The method of claim 8, comprising applying an electric current to the subterranean formation while flowing the EOR treatment fluid into the first wellbore, wherein the magnetic particles of the EOR treatment fluid propagate the electric current applied to the subterranean formation.

10. The method of claim 7, wherein applying the electric current to the subterranean formation comprises generating the electric current within the subterranean formation using an anode positioned within the first wellbore and a cathode positioned within the second wellbore.

11. The method of claim 7, wherein applying the electric current to the subterranean formation comprises generating the electric current using an anode positioned at a surface location and a cathode positioned within the second wellbore.

12. A method comprising:

alternating between:

(a) applying an electric current to a subterranean formation; and (b) flowing an enhanced oil recovery (EOR) treatment fluid into a wellbore formed in the subterranean formation, wherein a first iteration of flowing the EOR treatment into the wellbore occurs after a first iteration of applying the electric current to the subterranean formation, and the method comprises alternatingly repeating (a) and (b) at least 3 times and up to 12 times; and after alternatingly repeating (a) and (b), flowing an aqueous salt solution into the wellbore to mobilize hydrocarbons within the subterranean formation.

* * * * *